US005433127A

United States Patent [19]

Messier

[11] Patent Number: 5,433,127

[45] Date of Patent: Jul. 18, 1995

[54] MULTI-FUNCTIONAL JACK HANDLE

[76] Inventor: William L. Messier, R.D. #1, Box 272C, East Montpelier, Vt. 05651

[21] Appl. No.: 129,348

[22] Filed: Sep. 30, 1993

[51] Int. Cl.[6] ..... B66F 3/42; G05G 1/00

[52] U.S. Cl. ..... 74/543; 254/93 H; 254/DIG. 1; 60/482; 16/114 R

[58] Field of Search ..... 74/543, 504, 544; 254/93 R, 93 H, DIG. 3; 60/477, 481, 482; 116/114 R

[56] References Cited

U.S. PATENT DOCUMENTS

| | | | |
|---|---|---|---|
| 1,990,004 | 2/1935 | Shannon | 254/93 H X |
| 2,038,974 | 4/1936 | Werner | 60/482 |
| 3,871,619 | 3/1975 | Simon | 254/93 R |
| 3,959,970 | 6/1976 | Bos et al. | 60/477 |
| 4,048,800 | 9/1977 | Cancilla | 60/477 |

*Primary Examiner*—Richard M. Lorence
*Attorney, Agent, or Firm*—John J. Welch, Jr.

[57] ABSTRACT

There is here disclosed a multi-functional cylindrically shaped jack handle with a solid first end characterized by the presence of a centrally located notched out slot for receipt of flat release screws on hydraulic jacks, a first shoulder in proximity to the solid first end to prevent insertion of the handle too deeply into the inner compartment of a jack when pumping it up, a hollowed out second end characterized by the presence of two notches located directly across from one another in the perimeter of the hollowed out second end for receipt of ear screws on or within jacks and a second shoulder in close proximity to the hollowed out second end to prevent inadvertent insertion of this end into the well of a jack when pumping it up.

2 Claims, 1 Drawing Sheet

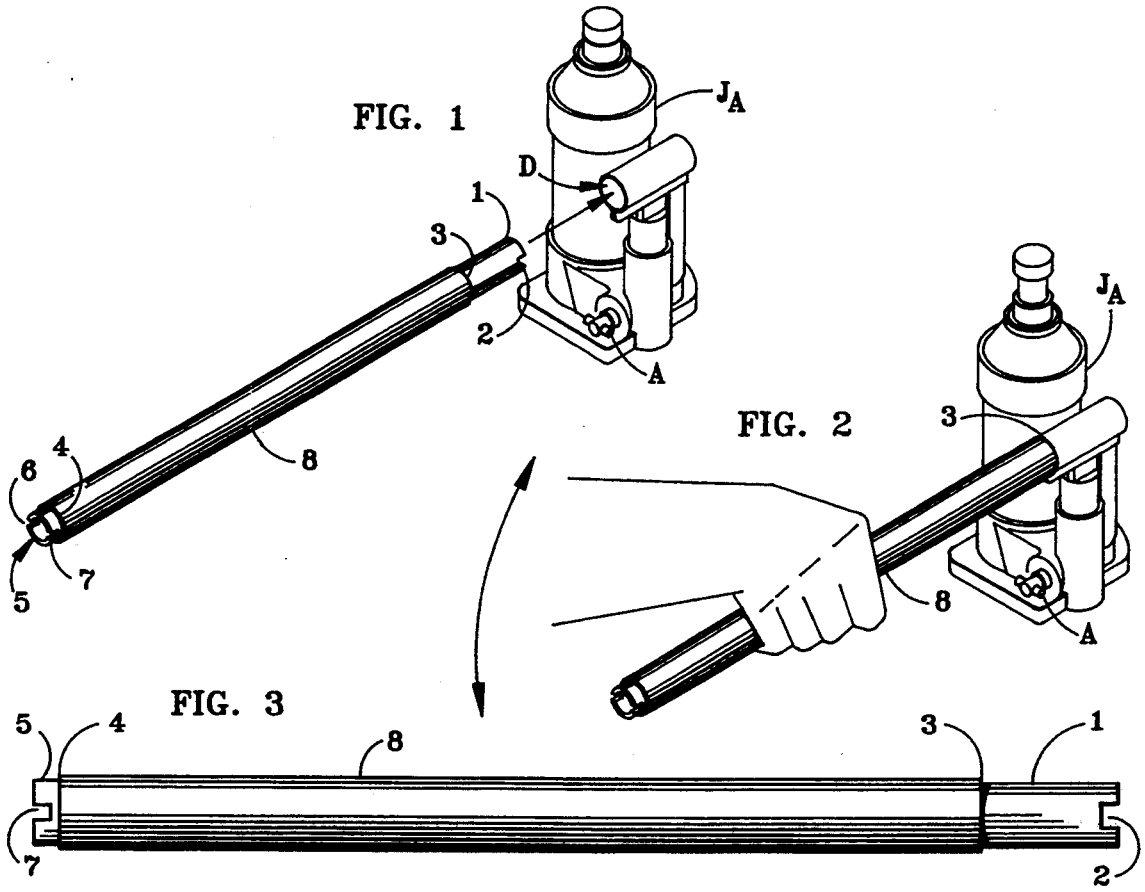
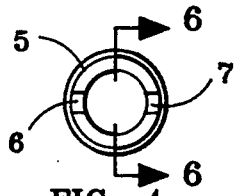
FIG. 4
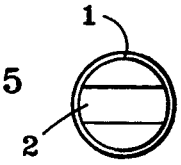
FIG. 5
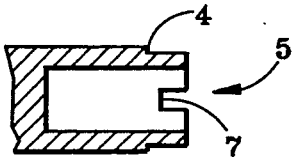
FIG. 6
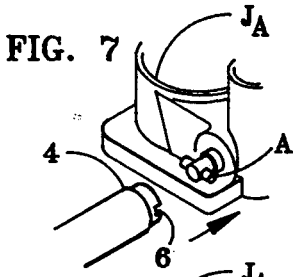
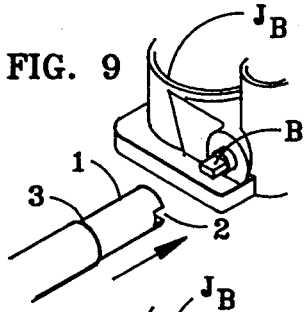
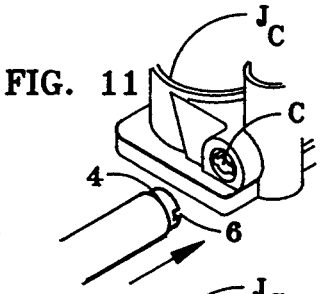
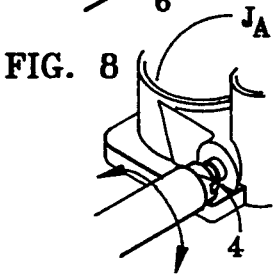
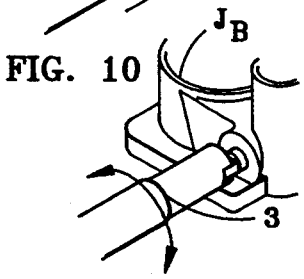
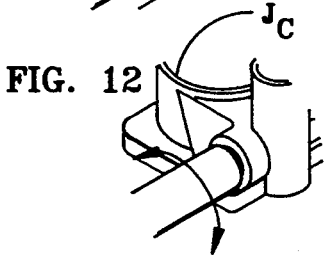

MULTI-FUNCTIONAL JACK HANDLE

TITLE OF THE INVENTION

The instant invention is entitled, A MULTI-FUNCTIONAL JACK HANDLE.

CROSS REFERENCES TO PRIOR APPLICATIONS

A prior application entitled, A Multifaceted Jack Handle was filed with the Patent and Trademark Office with filing date of Sep. 30, 1991 and Ser. No.: 767975 in contemplation of design patent protection. That application has recently been abandoned.

REFERENCES TO FEDERALLY SPONSORED RESEARCH AND DEVELOPMENT

There is no relationship between the instant invention and any federally sponsored research and development.

BACKGROUND OF THE INVENTION

Field of the Invention

The instant invention pertains to that class or category of devices that are used as handles to pump up and release load-bearing hydraulic jacks.

SUMMARY OF THE INVENTION

A Brief Description of the Invention

The invention is a cylindrically shaped handle made of metal or heavy plastic that has one solid flat slotted end in proximity to a first shoulder and a second end that is hollowed out and in close proximity to a second shoulder. The second end has two notches in its perimeter that are located directly across from one another. The slotted end serves to receive flat release screws on hydraulic jacks characterized by the presence of such screws. The hollowed out end serves to receive either external ear screws or recessed ear screws on hydraulic jacks characterized by the presence of such screws.

The Object of the Invention

By far, the vast majority of hydraulic lifting jacks in use and available for use today are those that possess either so-called flat release screws or ear screws that are either external or recessed, for purposes of facilitating the bringing down of a borne load by way of turning such flat or ear screws in such a way as to release the pressure within the jack bearing such a load. But, all other jack handles on the market and in use today function either to accommodate flat release screws or ear screws but not both. The instant device is virtually revolutionary in the field of jack handles in that it can accommodate either a flat release screw or an ear screw for purposes of releasing and letting down loads carried by flat release screw variants or ear screw variants. Also, all other jack handles on the market and in use today lack the double shoulder feature of the instant device. The first shoulder prevents a user of a jack from inserting the handle too far into a jack when pumping up jack with a load on it to be borne so as to thereby avoid damaging the internal parts of that jack when such pumping takes place. The second shoulder prevents a user of a jack from inserting tile hollowed out end of the handle into the jack when pumping up the jack with a load on it to be borne thereby obviating the chance that the hollowed out end could then be deformed and accordingly quite likely rendered useless. Other jack handles in use and on the market today lack such shoulders because one end is simply put into the jack to pump up a load and the other end is either slotted or hollowed out for purposes of accommodating flat release screws or ear screws for releasing loads. As might be reasonably be suspected, where such other conventional jack handles are concerned, there is the risk that they'll be inserted too far into the jack when it is being pumped up thereby putting the internal parts of the jack at risk of damage or, in the case of conventional jack handles with hollowed out ends for recessed ear screws, there is also the matter of the hollowed out end being inadvertently inserted into a jack to pump up a load thereby risking deformation of this end.

Moreover, because of its cylindrical shape, the jack handle can also be used as a means for rolling heavy loads from one point to another such as very large boxes containing massive amounts of materials without fear of deformation of the handle. One can simply put such a box on a couple of such jackhandles and roll it about from one point to another.

In closing, whereas, with respect to the instant device, there is no danger of inserting its hollowed out end to pump up a load due to the shoulder in close proximity thereto and there is no danger of inserting its slotted end too far into a jack to pump up a load due to the shoulder in proximity thereto and further whereas the instant device is readily amenable to accommodating either flat release screws or ear screws, external or recessed for purposes of releasing a load, it is respectfully asserted that the instant device is truly novel, unique and unquestionably useful and economical.

BRIEF DESCRIPTION OF THE DRAWINGS

FIG. 1 shows the instant invention in apposition to a hydraulic jack.

FIG. 2 shows the instant invention inserted into a hydraulic jack for purposes of pumping up a load to be supported by the jack.

FIG. 3 is a perspective view of the instant invention.

FIG. 4 is an end view of the instant invention showing its hollowed out end with two lateral notches one directly across from the other cut into the perimeter of the hollowed out end.

FIG. 5 is an end view of the instant invention showing its slotted other end with a notched out slot therein centrally located.

FIG. 6 is a cross-sectional cut view of the instant invention's hollowed out end and one of the two notches cut into the perimeter of the hollowed out end.

FIG. 7 shows the hollowed out end of the instant invention in apposition to a hydraulic jack characterized by the presence of an external ear screw for release purposes.

FIG. 8 shows the external ear screw of the hydraulic jack characterized by its presence in actual receipt by one of the two lateral notches in the perimeter of the hollowed out end of the instant invention.

FIG. 9 shows the slotted end of the instant invention with a centrally located notched slot in apposition to a hydraulic jack characterized by the presence of a flat release screw.

FIG. 10 shows the flat release screw of the hydraulic jack characterized by its presence in actual receipt by the centrally located notched slot of the solid end of the instant invention.

FIG. 11 shows the hollowed out end of the instant invention in apposition to a hydraulic jack characterized by the presence of a recessed ear screw for release purposes.

FIG. 12 shows the recessed ear screw of the hydraulic jack characterized by its presence in actual receipt by one of the lateral notches in the perimeter of the hollowed out end of the instant invention when the hollowed out end is inserted into the compartment portion of the jack where the recessed ear screw is to be found.

DESCRIPTION OF THE PREFERRED EMBODIMENT

FIG. 1 discloses the presence of the instant invention in apposition to a hydraulic jack. There are, essentially stated, three types of hydraulic jacks in use and marketed today with regards to how such jacks may be classified in terms of their characteristic release screws. Some jacks possess flat release screws. Some jack possess external ear screws for release purposes, and some possess recessed ear screws for release purposes. Such jacks are operated as follows. Release screws are tightened. Then jack handles are inserted into the inner compartments of such jacks in order to pump up such jacks to support loads. When the work required by such jacks is finished, then such release screws are loosened and the jacks are returned to their pre-load states. The jack JA shown in FIG. 1 is a variant characterized by the presence of an external ear screw A for release purposes. A jack characterized by the presence of a flat release screw or one characterized by the presence of a recessed ear screw for release purpose could have just as readily been depicted in FIG. 1. Conventional jack handles in use and on the market today have a solid faced first end coupled with either a solid functional second end with a centrally located notched out slot for receipt of flat release screws or a hollowed out functional second end with laterally placed notches in the perimeter of this end for receipt of ear screws, external or recessed for release purposes, but not both of such types of functional ends. Moreover, such conventional jack handles have no shoulders as does the instant invention. The lack of shoulders on such conventional jack handles results in essentially two types of potential problems when they're used to pump up a jack. On the one hand, the solid end of such handles could be pushed too far into a jack when its being pumped up or it could drift too far when its being pumped up with the result being that the internal parts of the jack would be rendered susceptible to damage. And, on the other hand, the hollowed out ends of those types of conventional jack handles characterized by the presence of such ends could inadvertently be inserted into a jack to pump up a load with the result being that during pumping deformation of these ends could occur thereby rendering such handles essentially useless for purposes of later turning an ear screw for release purposes. FIG. 1 shows shoulder 3 and shoulder 4 of the instant invention. Shoulder 3 allows for insertion of the solid flat slotted end 1 of the instant invention into the inner compartment of a jack to wit, jack JA to pump up the jack for load bearing purposes but serves to prevent the solid flat slotted end 1 from being inserted so far into the jack as to place the jack's internal parts at risk during such pumping up. Shoulder 4 as close as it is to the hollowed out end 5 of the instant invention absolutely prevents a jack user from inserting the hollowed out end 5 of the instant invention into the inner compartment D of a jack when pumping the jack up thereby obviating the risk of deformation of this end 5 of the instant invention. FIG. 2 shows actual insertion of the instant invention's solid flat slotted end first into the inner compartment of a jack JA only as far as is permitted by the locus of shoulder 3 thereby obviating the risk of damage to the internal parts of such a jack. FIG. 3 shows the instant invention, its solid flat slotted end 1 with centrally located notched slot 2, shoulder 3 in proximity to solid flat slotted end 1, its shaft 8, hollowed out end 5, shoulder 4 in close proximity to hollowed out end 5 and notch 7 in the perimeter of hollowed out end 5. FIG. 4 is an on end view of hollowed out end 5. There is further to be seen in FIG. 4 each of the two notches 6 and 7 located one directly across from the other in the perimeter of hollowed out end 5. FIG. 6 is a cross-sectional cut vertically through hollowed out end 5 showing the medial aspect of notch 7 in the perimeter of hollowed out end 5 as well as the locus of shoulder 4 in relation to the external aspect of hollowed out end 5. Contemplation of FIG. 4 and FIG. 6 allows appreciation for how hollowed out end 5 of the instant invention serves to receive either external ear screws or recessed ear screws for purposes of releasing loads borne by jacks characterized by the presence of either external ear screws or recessed ear screws. Shoulder 4 serves to permit access of hollowed out end 5 for purposes of receiving recessed ear screws in jacks equipped with such screws for load release purposes and yet likewise serves to prohibit inadvertent insertion of this end 5 into such jacks initially for purposes of pumping such jacks up. FIG. 7 shows hollowed out end 5 of the instant invention and notch 6 in the perimeter thereof (notch 7 is not seen in this view) in apposition to an external ear screw A of a hydraulic jack JA. FIG. 8 shows hollowed out end 5 by way of a notch 6 (notch 7 is not seen in this view) in the perimeter of hollowed out end 5 in actual receipt of the external ear screw A shown in FIG. 7. Release screw A is turned by way of notches 6 and 7 of hollowed out end 5 to effectuate release of a load and later turned the opposite way by the same manner of engagement and receipt to prepare jack JA for being soon pumped up by way of insertion of solid flat slotted end 1 into the inner compartment of that jack JA. FIG. 5 is an on end view of solid flat slotted end 1 of the instant invention showing its centrally located notched out slot 2. FIG. 9 shows solid flat slotted end 1 and centrally located notched out slot 2 in apposition to a flat release screw B of a hydraulic jack JB. FIG. 10 shows solid flat slotted end 1 and its centrally located notched out slot 2 in receipt of flat release screw B of hydraulic jack JB. Flit release screw B is turned one way to release a load held by jack JB and later turned the opposite way with resort to utilization of centrally located notched out slot 2 to receive it in order to prepare jack JB for being soon pumped up by way of insertion of solid flat slotted end 1 into the inner compartment D of that jack JB. FIG. 11 shows hollowed out end 5 and notch 6 in the perimeter thereof(notch 7 is not seen in this view) in apposition to a recessed ear screw C of a hydraulic jack JC. FIG. 12 shows hollowed out end 5 inserted into the base of hydraulic jack DC to the extent of the locus of shoulder 4 for receipt by notches 6 and 7 herein not shown of recessed ear screw C. Recessed ear screw C is turned by way of notches 6 and 7 of hollowed out end 5 to effectuate release of a load and later turned the opposite way by the same manner of engagement and receipt to prepare jack JC for being soon pumped up by way of insertion of solid flat slotted end 1 into the inner compartment of that jack JC.

All of the foregoing contemplates the machining of one piece of tubing in order to create what has just been described. However, the same could be accomplished by machining a piece of hollow tubing so as to create what has been described above as hollow end 5 and permanently inserting a solid cylinder with a smaller diameter than such piece of hollow tubing into its other end with the solid cylinder having one flat end with a notched out slot centrally located as is described above with respect to solid flat slotted end 1.

As can be appreciated in view of the foregoing, respectfully submitted, the instant invention represents a radical departure from the current art in respect of the nature and essence of conventional jack handles in use and on the market today. The instant invention in view of its two functional ends and shoulders is, as will hopefully be concluded indeed,new, useful and unique.

What is claimed is:

1. A cylindrically shaped multi-functional jack handle, comprising:

a. a solid cylindrically shaped handle with a flat first end with a rectangularly shaped slot notched into it which said slot extends from one side of said flat first end to the other side of said flat first end and further which said slot is centered in said flat first end;

b. a first shoulder in proximity to said flat first end demarcating the first locus along the shaft of said solid cylindrically shaped handle where the diameter of said shaft is larger in size relative to the size of the diameter of said shaft in closer proximity to said flat first end;

c. a second end of said solid cylindrically shaped handle that is round and hollowed out of the said shaft with two identical rectangularly shaped notches cut into the perimeter of said second end such that said two identical rectangularly shaped notches are lying within said perimeter directly across from one another;

d. a second shoulder in closer proximity to said second end than said first shoulder is in respect of said first shoulder's proximity to said first end which said second shoulder demarcates the second locus along the said shaft of said solid cylindrically shaped handle where the diameter of said shaft is larger in size relative to the size of the diameter of said shaft in closer proximity to said second end;

e. said shaft being of one constant diameter size between the locus of said first shoulder and the locus of said second shoulder.

2. The cylindrically shaped multi-functional jack handle of claim 1, whereby said shaft is hollowed out everywhere between the locus of said first shoulder and the outer edge of said second end.

* * * * *